US005691285A

United States Patent [19]

Coffey et al.

[11] Patent Number: 5,691,285

[45] Date of Patent: Nov. 25, 1997

[54] NONTOXIC LUBRICANT COMPOSITION

[75] Inventors: Gary L. Coffey, Glendale; B. Howard Coffey, LaGrange, both of Ky.

[73] Assignee: Coffey Marketing Corporation, Buckner, Ky.

[21] Appl. No.: 536,669

[22] Filed: Sep. 29, 1995

[51] Int. Cl.[6] ..... C10M 101/04

[52] U.S. Cl. ..... 508/491; 508/110; 585/1

[58] Field of Search ..... 252/9, 43; 585/1, 585/2, 3; 508/491; C10M 127/00

[56] References Cited

FOREIGN PATENT DOCUMENTS 4473093 2/1994 Australia .

*Primary Examiner*—Stephen Kalafut
*Assistant Examiner*—Cephia D. Toomer
*Attorney, Agent, or Firm*—Middleton & Reutlinger; David W. Carrithers

[57] ABSTRACT

A nontoxic and biodegradable lubricant composition for use to reduce the friction between the contact surfaces of devices which come into contact with people and animals. The lubricant composition is especially useful for application to sports equipment which comes into contact with the human body. Another application concerns the use of the nontoxic lubricant composition in connection with food processing equipment which comes into direct contact with the food substrate. The nontoxic lubricant composition includes a nontoxic oil base such as vegetable oil, preferably corn oil or olive oil, and a nontoxic solvent such as ethanol, preferably ethyl alcohol, and/or a citrus solvent, such as a terpene compound, preferably limonene. The preferred embodiment also includes limonene as a nontoxic flavoring and/or scenting agent to provide good wetting and film forming properties and a pleasant naturally occurring organoleptic fragrance and scent.

7 Claims, No Drawings

NONTOXIC LUBRICANT COMPOSITION

BACKGROUND OF THE INVENTION

The present invention relates to a nontoxic and biodegradable lubricant composition for use to reduce the friction between the contact surfaces of devices which come into contact with people and animals. The lubricant composition is especially useful for application to sports equipment which comes into contact with the human body and/or food processing equipment which comes into contact with the food substrate. Another particular application concerns the use of the nontoxic lubricant composition in connection with food processing equipment which comes into direct contact with the food substrate. The nontoxic lubricant composition includes a nontoxic oil base such as vegetable oil, preferably corn oil or olive oil, and a nontoxic solvent such as ethanol, preferably ethyl alcohol, and/or a citrus solvent, such as a terpene compound, preferably limonene. The preferred embodiment also includes limonene as a nontoxic flavoring and/or scenting agent to provide good wetting and film forming properties and a pleasant naturally occurring organoleptic fragrance and scent.

It has been the prior practice to use petroleum based lubricants such as glycols, "VASELINE™", or the like, or to use silicone materials applied to the food processing equipment. While such materials have generally been used as lubricants they have not been entirely satisfactory in connection with food prepartaion and minimization of contamination thereto. Further, conventional lubricants are not ingestible. This presents a problem when the food article is contaminated with the lubricant and can in fact cause difficulties if ingested.

SUMMARY OF THE INVENTION

The present invention is directed to a nontoxic lubricant composition for use to reduce the friction between the contact surfaces of devices which come into contact with sports equipment. The lubricant composition is especially useful for application to athletic equipment and/or food processing equipment.

The lubricant composition includes a nontoxic oil base such as vegetable oil, preferably corn oil or olive oil, and a nontoxic solvent such as ethanol, preferably ethyl alcohol, and/or a citrus solvent such as a terpene compound preferably limonene. The preferred embodiment includes a terpene compound preferably limonene as a nontoxic citrus solvent which has flavoring and scenting properties which may be use with the vegetable oil or in combination with the ethanol. Limonene provides a pleasant naturally occurring organoleptic scent which is useful to provide a clean scent to the user; furthermore, limonene has good wetting properties and film forming properties.

Moreover, the lubricant composition of the present invention may be used as a nontoxic and/or scented lubricant for application to other mechanical components of athletic equipment or to reduce the friction of other rubbing surfaces of food processing equipment which is likely to come into contact with the food substrate such as with a meat grinder, slicer, or saw. The biodegradable nontoxic lubricant composition of the present lasts longer than conventional lubricant compositions, does not accumulate and cause build-ups as does petroleum based lubricants, is easy to remove with readily available detergents.

DETAILED DESCRIPTION OF THE PREFERRED EMBODIMENT

Lubricant compositions within the scope of the present invention can be compounded to include only materials which can be safely ingested so that the compositions are safe for storage and use. The lubricant compositions are particularly important for applications where petroleum based materials are replaced and there is a likelihood of ingestion or absorption by humans over a sustained period of time.

The lubricant composition includes a nontoxic natural vegetable oil base, preferably corn oil; and a nontoxic ingestible solvent, preferably ethyl alcohol, ("ethanol"); and/or a citrus solvent such as terpene preferably limonene. The lubricant compositions within the scope of the present invention include at least 40% of an ingestible vegetable oil such as corn oil, olive oil, coconut oil, peanut oil, or other readily available natural vegetable oils. The balance of the lubricant composition, as much as 60% is an nontoxic ingestible solvent for controlling the viscosity of the lubricant such as an alcohol, preferably ethanol or ethyl alcohol; or a citrus solvent such as a terpene compound preferably limonene. The preferred embodiment includes a solvent combination of ethyl alcohol and limonene as a citric solvent which is also a nontoxic flavoring and/or scenting agent. Limonene to provides a pleasant naturally occurring organoleptic scent which is useful in hunting applications to aid in masking the scent of the hunter.

Examples of compositions within the scope of the present invention are described hereinafter but it will be understood that neither the accompanying illustrations nor the descriptions thereof are by way of limitation and that other arrangements also within the scope of the present invention will occur to those skilled in the art upon reading the disclosure set forth hereinafter.

The lubricant composition of the present invention comprises from about 40 to about 98 percent vegetable oil and about 2 to about 60 percent solvent, wherein the solvent is a nontoxic solvent such as an alcohol such as ethanol, and/or a citrus solvent such as limonene. More preferably, the lubricant composition of the present invention comprises from about 20 to about 80 percent vegetable oil and about 20 to about 80 percent solvent, wherein the solvent is a nontoxic solvent such as an alcohol such as ethanol, and/or a citrus solvent such as limonene. More preferably, the lubricant composition of the present invention comprises from about 20 to about 80 percent vegetable oil and about 20 to about 80 percent solvent, wherein the solvent is a combination of about 10 to about 50 percent of an alcohol such as ethanol and about 10 to 50 percent of a citrus solvent such as limonene. In the preferred embodiment, the lubricant composition of the present invention comprises about 40 percent vegetable oil such as corn oil, about 30 percent of an alcohol such as ethanol, and about 30 percent of a citrus solvent such as limonene. Thus, the preferred embodiment utilizes a proportions of the citrus solvent and alcohol solvent.

It should be noted that a combination of about 98 percent corn oil and of about 2 percent of a solvent, or about 2 percent of a corn oil and about 98 percent of a solvent will provide some lubricating properties; however, the components of the mixtures separate upon standing and require shaking to stay in solution before use. Therefore, at these levels another component is needed to stabilize the solution at these levels.

The alcohol provides a superior viscosity control agent as compared to the citrus solvents; however, the alcohol and vegetable oil combination have a peculiar odor, such as associated with hospitals, which one may find undesirable. Moreover, the lubricant composition of the present invention may also comprise solely a vegetable oil such as corn oil and a citrus solvent such as limonene; however, the cost of the limonene is generally much greater than the ethanol and the limonene is not as effective of a solvent for viscosity control.

Furthermore, the combination of a vegetable oil, an alcohol, and a limonene provides a particularly stable lubricant composition having long lasting qualities. Limonene is a widely distributed optically active terpene having a formula of $C_{10}H_{16}$. It occurs naturally in both d and l forms. The racemic mixture of the two isomers is known a dipentene. It is a colorless liquid which oxidizes to form a film in the air, similar to that of rubber or drying oils. It can be derived from citrus fruits such as lemon or orange, as well as bergamot, caraway and other oils such as peppermint and spearmint oils. It is commonly used for flavoring, fragrance, and perfume materials, solvents, wetting agents, and for resin manufacturing. It is also contemplated that limonene dioxide, dipentene dioxide, and limonene monoxide, dipentene monoxide, can be substituted for limonene in the above lubricant compositions.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. A nontoxic, biodegradable lubricant, comprising:

from about 40 to about 98 percent vegetable oil, end about 2 to about 60 of a solvent, wherein said solvent is selected from the group consisting of ethanol, a citrus solvent, and mixtures thereof.

2. The nontoxic, biodegradable lubricant of claim 1, wherein said vegetable oil is selected from the group consisting of corn oil, olive oil, coconut oil, peanut oil, and combinations thereof.

3. The nontoxic, biodegradable lubricant of claim 1, wherein said citrus solvent is a terpene compound.

4. The nontoxic, biodegradable lubricant of claim 1, wherein said terpene compound is selected from the group consisting of limonene, limonene dioxide, dipentene dioxide, limonene monoxide, and dipentene monoxide.

5. The nontoxic, biodegradable lubricant of claim 4, wherein said terpene is dipentene dioxide or dipentene monoxide, said dipentene compound providing film forming properties to the lubricant and functions as a wetting agent.

6. The nontoxic, biodegradable lubricant of claim 1, said ethanol providing means for controlling the viscosity of said lubricant.

7. The nontoxic, biodegradable lubricant of claim 1, said lubricant comprising about 40 percent of said vegetable oil, about 30 percent of said citrus solvent and about 30% of said ethanol.

* * * * *